US007421833B2

(12) United States Patent
Rothbauer et al.

(10) Patent No.: US 7,421,833 B2
(45) Date of Patent: Sep. 9, 2008

(54) METHOD AND DEVICE FOR CONTROLLED FILLING

(75) Inventors: Juergen Rothbauer, Michelfeld (DE); Bernd Laukenmann, Onolzheim (DE)

(73) Assignee: inova pharma systems GmbH, Schwaebisch Hall (DE)

( * ) Notice: Subject to any disclaimer, the term of this patent is extended or adjusted under 35 U.S.C. 154(b) by 0 days.

(21) Appl. No.: 11/384,653

(22) Filed: Mar. 20, 2006

(65) Prior Publication Data

US 2006/0191240 A1 Aug. 31, 2006

Related U.S. Application Data

(63) Continuation-in-part of application No. 10/945,415, filed on Sep. 20, 2004.

(30) Foreign Application Priority Data

Mar. 21, 2005 (DE) ..... 10 2005 014 116

(51) Int. Cl.
*B65B 7/28* (2006.01)

(52) U.S. Cl. ..... 53/471; 53/478; 53/502; 53/173; 53/284.6

(58) Field of Classification Search ..... 53/471, 53/478, 502, 173, 281, 284.6, 287; 222/77; 177/2

See application file for complete search history.

(56) References Cited

U.S. PATENT DOCUMENTS

| | | | | |
|---|---|---|---|---|
| 5,004,093 | A | 4/1991 | Blezard | |
| 5,581,975 | A | 12/1996 | Trebbi et al. | |
| 5,806,287 | A * | 9/1998 | Trechsel | 53/502 |
| 6,044,876 | A | 4/2000 | Ally et al. | |
| 2006/0191240 | A1 | 8/2006 | Rothbauer et al. | |

FOREIGN PATENT DOCUMENTS

| | | |
|---|---|---|
| DE | 299 23 418 U1 | 10/2000 |
| DE | 696 13 109 T2 | 3/2002 |

OTHER PUBLICATIONS

German Search Report Doc. No. 103 45 338.5 dated Feb. 17, 2004.

* cited by examiner

*Primary Examiner*—Hemant M Desai
(74) *Attorney, Agent, or Firm*—Boyle Fredrickson, S.C.

(57) ABSTRACT

In the case of nested containers to be filled by a filling station, a gripping device grasps an entire row of empty containers and conveys it to a weighing station, where the containers are weighed. Following weighing, all containers of the row are simultaneously filled and then reweighed. The containers are then reinserted into the nest and sealed, without being refilled, which allows checking the operation of the filling station without wasting product.

17 Claims, 2 Drawing Sheets

METHOD AND DEVICE FOR CONTROLLED FILLING

This is a continuation-in-part of U.S. patent application Ser. No. 10/945,415, filed Sep. 20, 2004 and now pending.

BACKGROUND OF THE INVENTION

The invention relates to a device and a method for the controlled filling of nested containers, in particular, in the pharmaceutical field.

The invention relates to a device and a method for the controlled filling of nested containers, in particular, in the pharmaceutical field.

The term "containers" is to be construed as implying vessels that are to be filled with, for example, liquids, in particular, pharmaceuticals. Included thereunder are syringes, vials, capsules, etc. The term "nested containers" is to be construed as implying containers that have been arranged in a nest or rack for further processing. Preferably involved are disposable syringes that are supplied nested and sterily packed in a box for further processing.

The proper operation of filling stations must be checked at regular intervals by measuring, or weighing, the contents of a container. That checking is also termed "in-process process control." Such checking may be conducted at regular or irregular intervals, since it may be presumed that any changes in filling accuracy will occur relatively gradually. However, every container may also be individually checked.

In cases where individual containers are to be filled, weighing them prior to their being filled and reweighed after having been filled is presently known. The second weighing must take place before the container is sealed, since the plugs with which containers are sealed may have relatively large tolerances. That sort of checking will be sufficient when filling individual containers, since conclusions regarding the operation of the filling station involved may be drawn.

A device for weighing pharmaceutical vessels, in particular, ampoules, is known (cf. DE-U 29923418). However, on that device, vessels are conveyed, one after the other, on a transport rack, rather than being nested. A gripping device grasps several vessels from beneath the filling station and withdraws them sideward. That sort of processing is inapplicable to nested containers.

However, in the case of nested containers, several containers are simultaneously filled, which means that no conclusions regarding proper operation of a filling station may be drawn. Moreover, in the pharmaceutical field, sealing containers as soon as practicable after filling is either desirable, or demanded by regulations.

The usual practice employed to date when continuously monitoring nested containers has been manually removing several containers, extracting their contents, and measuring their contents, which requires substantial amounts of manual labor and invariably yields inaccurate results. Moreover, the extracted product is wasted. In the case of pharmaceutical products, the products involved might be very expensive.

The invention is based on the problem of devising means for conducting in-process process controls that are to be automatically conducted and capable of yielding conclusions regarding the proper operation of the filling station employed, even when filling nested containers.

SUMMARY OF THE INVENTION

The invention thus proposes picking up an entire row of containers to be filled using a gripping device, weighing it in the empty state, subsequently conveying it to the filling station, having the row filled there, and then reweighing that row before its containers are sealed, which will check all of the filling station's filling nozzles. Variations in the quantities dispensed or malfunctioning of each and every individual filling nozzle may be detected and noted.

Within the nests, the containers are arranged in rows, where several rows follow one another. In order to fill individual rows consecutively, the filling station might be cyclically conveyed such that it is capable of progressively filling every row. However, it will be particularly sensible if, in elaborating on the invention, the nests, together with the containers, are conveyed, controlled by a controller that determines the incremental advance and cycle time. In particular, that controller might also be utilized for logging the row of the containers picked up and weighed, as well as the results of checking each and every individual container present in the row, and not merely the row.

That although that checking of individual containers could, in principle, be extended to include every container, it will usually be sufficient to conduct checks at more or less lengthy intervals, was mentioned above. The choice of intervals may also be left up to the controller. Weighing might also be triggered at random.

According to the invention, it may be provided that the gripping device is configured such that it reinserts the row of containers between the filling station and the sealing station, which is one way of precluding that containers that have already been filled will be refilled, since one of the objectives of the invention is that weighed containers will be returned to the process for further processing in order that no product will be wasted.

The gripping device might also be configured such that it reinserts the row of containers into the nest ahead of the filling station, and such is proposed by the invention. That means that the nest will not be advanced during checking procedures, in which case, other measures may be undertaken in order to provide that the containers will not be refilled, which may be accomplished by providing a monitoring device on the filling station that checks all containers in order to determine whether they are empty. However, since the location of the checked row is logged by the controller, the controller may also interrupt the operation of the filling station, even during that single cycle.

That mode of reinserting the row of checked containers has the advantage that the sealing station may be arranged immediately following the filling station in order that demands that filled containers be sealed immediately after filling may be met in all those cases where no checking is conducted.

Although the containers of a row that have been filled employing a single procedure might be individually sealed, the invention also proposes, under an elaboration thereon, that the sealing station seal the containers row-by-row.

During weighing of the containers, when a certain interruption of processing occurs anyhow, it may be provided that the weighing station weighs containers individually. The weighing station may have at least one weighing cell that is configured such that the gripping device may set a container thereon for that purpose. The gripping device will then release the container during the weighing procedure. Several weighing cells might also be present in order that several containers may be simultaneously weighed. Of course, it would be best if the number of weighing cells equaled the number of containers in a row in order that all containers of a row could be simultaneously weighed.

According to the invention, it may be provided that the gripping device has a multi-axis robot arm that is capable of executing all of the necessary motions, which will also allow attaching a checking device to a filling device that is already present in the manner described.

The robot arm might be controlled by the controller such that it is capable of picking up the row of containers to be checked at any location on the nest, or from just one particular location thereon.

The method proposed by the invention proceeds such that the containers of a row of a nest will be simultaneously filled and subsequently sealed. A row of containers will be picked up from the nest prior to being filled and weighed in the empty state at certain regular or irregular intervals. The containers of that row will be subsequently simultaneously filled and reweighed. Following that second weighing, the row will be reinserted into the nest and its containers sealed. The results of those weighings will be logged and analyzed by a controller.

According to the invention, under an elaboration thereon, all containers of a row may be simultaneously sealed and/or weighed.

Nests having several rows of containers are preferably cyclically advanced, where, in particular, the row of weighed containers is reinserted at that location thereon that is situated ahead of a filling station.

BRIEF DESCRIPTION OF THE DRAWINGS

Further features, details, and benefits of the invention will be evident from the claims and the abstract, both of whose wordings are herewith made integral parts of the content of this description by way of reference thereto, the following description of a preferred embodiment of the invention, and the figures, which depict:

DETAILED DESCRIPTION

Figure 1:
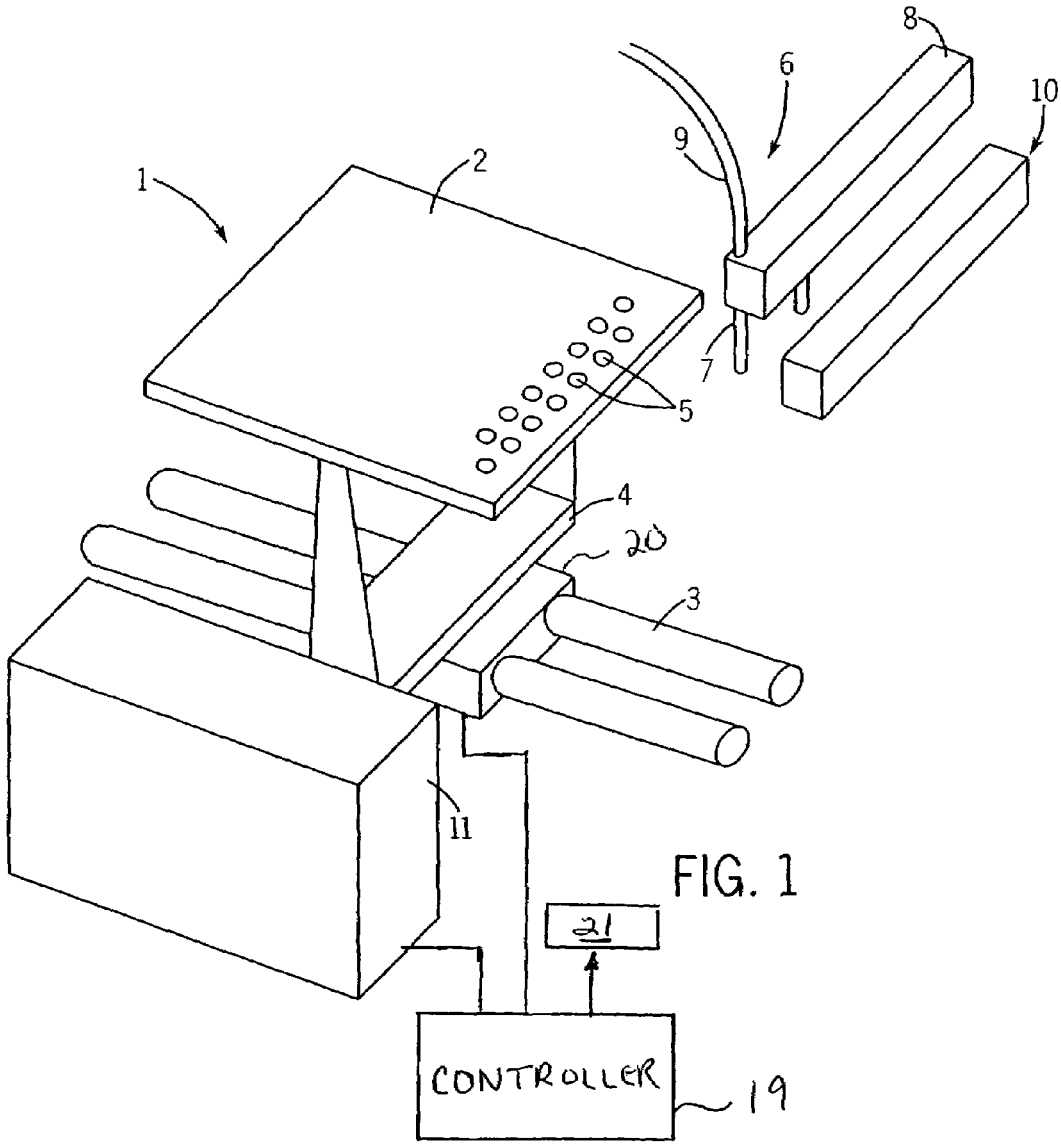
FIG. 1 a schematized view of a holder for a container approaching a filling station.

In the case of nested containers, a single, complete, nest is fed in for processing. The nests employed have variable packing densities that depend upon the types of containers involved. Both the number of containers present in the individual rows and the maximum number of containers per row may be variable. Processing of the containers of a nest will usually proceed row-by row, where a given row may be processed during one or more cycles. Important in the case of pharmaceuticals is that filled containers of a row be sealed during the next cycle whenever feasible.

Nests are fed in for processing by a special conveyor system, where the individual containers of the nests have already been laid out in the arrangement in which they will be subsequently conveyed. They thus have a very high packing density in order to conserve space, where their high packing density is maintained throughout all stages of processing. An attempt to indicate that appears in FIG. 1. The containers are inserted into a holder 1 that has a plate 2. The plate 2 is held in place atop rails 3 by a rider 4. The plate 2 has rows of holes 5, in which the containers are arranged. As may be seen from the simplified representation of FIG. 1, the rows of holes 5 are offset such that the holes of the next consecutive row are centered between the holes of the respective preceding row, which allows achieving higher packing densities. Employing a drive 20, which is controlled by a controller 19 will allow cyclically conveying the holder 1 along the rails 3. The drive 20 is configured such that short excursions of the holder 1 transverse to the direction of transport may also be effected in order to allow aligning the holes of all rows, including those having offset holes along a common set of parallel lines.

A filling station 6 that has a row of filling nozzles 7 that are attached to a holder 8 is situated above the holder 1. Every filling nozzle 7, only two of which are shown in FIG. 1 for simplicity, is connected to a device for dispensing the pharmaceutical to be injected by a length of tubing 9. The holder 8 may be raised and lowered by the controller in order to provide that the filling nozzles 7 may be inserted into at least the top sections of the containers.

A sealing station 10, which is also indicated by a single bar in FIG. 1, is arranged following the filling station, referred to the direction of transport, which runs from the left-background to right-foreground in FIG. 1. Plugs are inserted into the top ends of the containers at the sealing station. That sealing station 10 may also be raised and lowered.

As shown in FIG. 1, a weighing station 11 that weighs the containers as described above is arranged ahead of the system.

Figure 2:
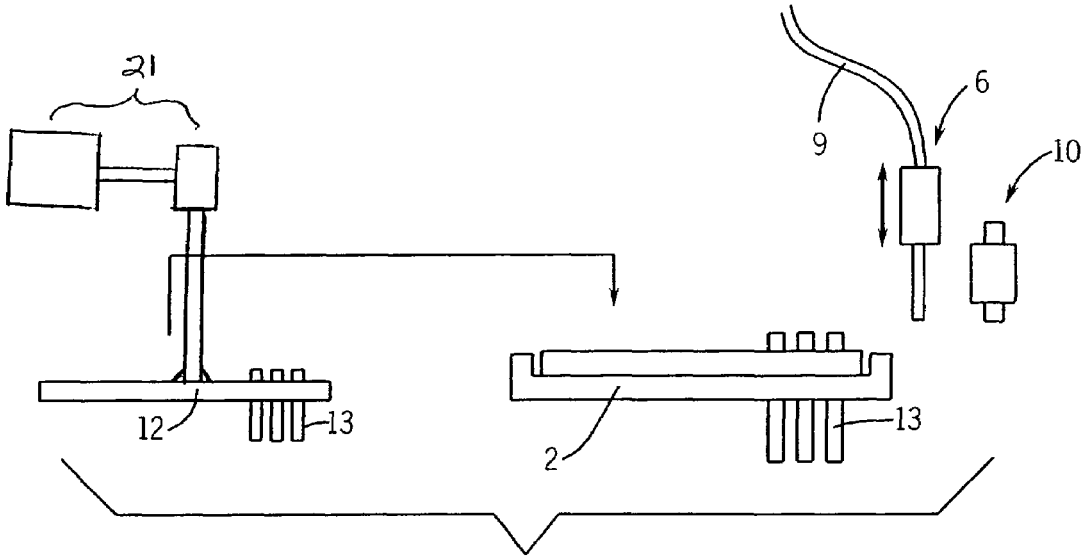
FIG. 2 a side view illustrating the processing stages involved.

Let us now turn to FIG. 2, which schematically illustrates the processing stages involved when the device according to the invention is employed. A nest 12 of containers 13 arranged in a row is fed in. The nest might be a thin plastic plate, in which the containers 13 have already been arranged in the desired packing density. The nest 12 holds, and secures, the containers 13 in place, even when in their shipping packagings. For example, the containers 13 might be suspended in apertures in, or cylindrical protrusions on, the nest, with their free ends extending downward. In order to simplify the task of inserting containers into the nest 12, the containers 13 have play in their holders. The diameters of the holes in the plate are thus somewhat larger than the diameters of the containers.

The nest 12 is suspended on the plate 2 shown in FIG. 1 by a device that is not shown. As mentioned above, that plate 2 has the holes 5 that correspond to the locations of the containers 13. The nest 12, or plastic plate, thus rests on the metal plate 2.

The holder 1 is then cyclically advanced by a drive that is not shown, but has been mentioned above, where its transport will invariably be interrupted whenever a row of containers 13 is arranged immediately below the filling station 6. The filling nozzles 7 on the filling station 6 will then drop down and fill the containers 13. The holder 1 will then be conveyed one cycle onward, where the excursion orthogonal to the plane of the paper mentioned above will then simultaneously occur. Shortly after filling, the containers will be sealed by the sealing station 10 inserting plugs therein.

Figure 3:
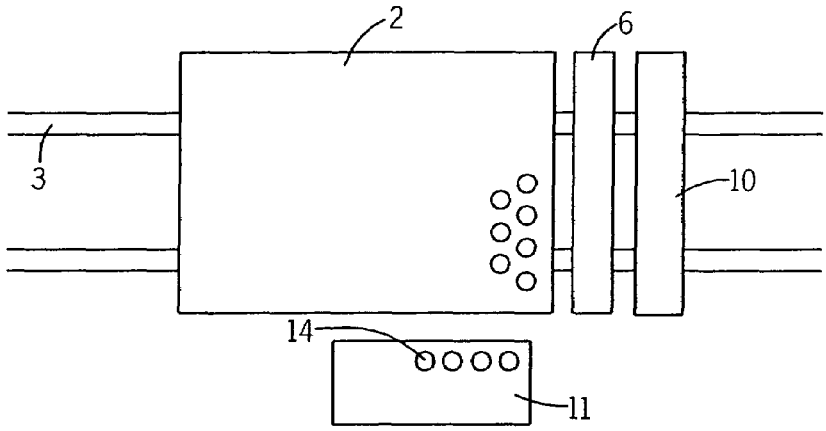
FIG. 3 a top view of the arrangement shown in FIG. 2.

FIG. 3 depicts a top view of he arrangement shown in FIG. 2. The holder, together with the plate 2 and the containers 13 inserted therein, is shown immediately ahead of the filling station 6. The weighing station 11, which has a row of weighing cells 14, is situated off to the side, alongside the transport path. The number of weighing cells 14 preferably equals the number of locations per row for accommodating containers 13. The number of weighing cells might be greater than that in order to allow the device to handle variously dimensioned containers. A single weighing cell for compensating for the air current prevalent in a cleanroom in which the device is arranged might also be present.

Figure 4:
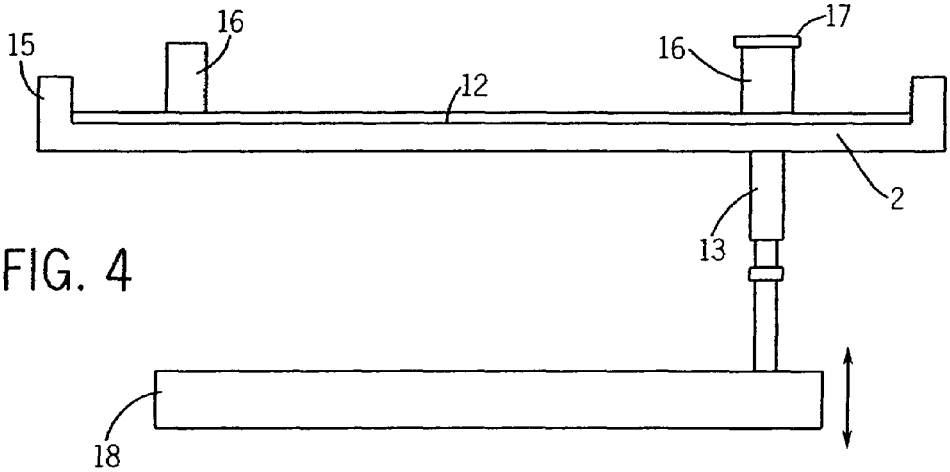
FIG. 4 a frontal view of the holder for a container.

FIG. 4 depicts a greatly magnified, but still schematized, view of the holder, as viewed from the right in FIG. 1. It may be seen that the plate 2 with a rim 15 accommodates the packaging plate 12. Only a few components of this arrangement are shown. The packaging plate 12 has a hollow, cylindrical, protrusion 16, whose inner diameter is slightly greater than the outer diameter of the container, for every container 13. The containers are inserted into the cylindrical protrusions 16 and remain suspended there, since their top ends have circumferential lips 17 that are larger than the protrusions 16.

The free ends of the suspended containers 13 protrude from the underside of the supporting plate 2. A strip 18 that may be raised and lowered, and will be raised whenever a row of containers 13 is to be removed from the plate 2 in order that a gripping device 21 (FIG. 2) will then be able to grasp the containers 13, is arranged on the underside of the plate 2. The containers 13 will then protrude from the cylindrical protrusions 16. The gripping device 21 is capable of grasping the walls of the containers 13 using a suction device and lifting the containers 13 clear of the holder brings the containers 13 to the weighing station's weighing cells 14 and releases them. They are then weighed. The gripping device 21 then grasps the containers once again and holds them under the filling nozzles 7 on the filling station 6. The containers 13 of that row will then be jointly filled. The gripping device 21 then sets the containers 13 of that row onto the weighing cells 14 a second time, releases them, and picks them up after they have been reweighed. It then reinserts them into the exact same row of cylindrical protrusions 16 or holes 5 from which it removed them. While that is transpiring, the holder 1 remains stationary, i.e., is not advanced. If the row of containers 13 that has just been weighed and already been filled should land under the filling station, then the controller will control the latter such that it will not dispense any liquid during that cycle. As soon as that row has been advanced, it will receive the same treatment as a normal row of containers, that is, its containers will be sealed by plugs when it reaches the sealing station.

However, the device that has thus far been described may also run a modified process. When filling starts, a row of containers will be picked up and the device for filling them will be restarted. While unchecked containers are being filled and sealed in the manner described above, the row of containers that has been picked up will be weighed in the empty state. The last batch of containers to be checked that was picked up will be filled and reweighed while switching from one nest to the next, during which operation of the filling machine will be briefly interrupted. While operation of the filling machine is interrupted, a new row of containers to be checked will be picked up and those containers that were checked, that is, filled and reweighed, immediately prior to its being picked up will be inserted into those locations left vacant by it. Processing will then be continued.

In other words, the containers that have been picked up are inserted into locations on a nest that follows the nest from which they were picked up, rather than locations on the nest from which they were picked up. The advantage of that manner of proceeding is that the machine can continue turning out finished products during the relatively lengthy weighing cycles.

Filling of the containers to be checked might also take place while switching from one nest to the next, that is, while the filling device is not filling any containers of any nests, which will allow significantly reducing machine dead time per checking cycle.

The invention claimed is:

1. A device for the controlled filling of a plurality of containers, wherein the containers are arranged in a plurality of parallel rows in a holder (1), wherein the device comprises:

a drive for advancing the rows of containers (13) in a direction of travel that is transverse to the rows of containers, wherein the rows are spaced apart in the direction of travel;

a filling station (6) for simultaneously filling containers in one of the parallel rows of containers (13) in the holder (1), and wherein the rows of containers (13) are advanced incrementally one row at a time, the rows being transverse to the direction of travel to be filled by the filling station;

a sealing station (10) for sealing the containers (13) after the containers (13) have been filled at the filling station;

a weighing station (11) for weighing the containers (13), at least one container (13) at a time, the weighing station being disposed to one side of a path of travel for advancing rows of containers;

a gripping device for picking up a row of containers (13) to be filled and transferring the row of containers (13) to the weighing station (11) for weighing before filling;

the gripping device then transferring the row of weighed containers (13) from the weighing station (11) to the filling station (6), and after filling, the gripping device then transferring the row of filled containers (13) to the weighing station (11) for weighing after filling; and after weighing, the gripping device then transferring the weighed and filled row of containers (13) to a row in the holder following a row from which the containers (13) were removed, with such transferring occurring, ahead of the sealing station (10).

2. A device according to claim 1, having a controller that is configured to maintain a log of the row of weighed containers (13).

3. A device according to claim 1, having a controller that is controlled by at least one of a timed sequence and a random sequence.

4. A device according to claim 1, wherein the gripping device is configured such that it reinserts the row of containers (13) between the filling station (6) and the sealing station (10).

5. A device according to claim 1, wherein the gripping device is configured such that it reinserts the row of containers (13) into the holder (1) ahead of the filling station (6).

6. A device according to claim 1, wherein the operation of the filling station (6) is interrupted by the row of filled containers (13) being weighed and then the filled containers being logged by a controller.

7. A device according to claim 1, wherein the sealing station (10) is arranged immediately following the filling station (6) and simultaneously seals all containers (13) of that row that has just been filled.

8. A device according to claim 1, wherein the weighing station (11) has at least one weighing cell (14) and containers (13) are individually weighed, one after the other, if desired.

9. A device according to claim 1, wherein the weighing station (11) has a row of weighing cells (14) and all containers (13) of a row are simultaneously weighed.

10. A device according to claim 1, wherein the gripping device has a multi-axis robot arm.

11. A method for the controlled filling of nested containers (13) that are arranged in parallel rows in nests (12) comprising the following processing stages:

advancing the nests (12) having several rows of containers (13) cyclically along a direction transverse to the axes of the rows;

intermittently picking up a row of containers (13) from the nest (12) and weighing the containers (13) in an empty state, simultaneously filling the weighed containers (13) of that row as the containers are advanced along the direction transverse to the rows, subsequently sealing the filled containers (13) as the containers are advanced along the direction transverse to the rows, weighing the weighed and filled containers (13) a second time, and reinserting the reweighed row of containers (13) into a nest (12) that follows the nest (12) from which the containers were first picked up.

12. A method according to claim 11, wherein all containers (13) of a row are simultaneously sealed.

13. A method according to claim 11, wherein all containers (13) of a row are simultaneously weighed.

14. A method according to claim 11, wherein the row of weighed containers (13) is reinserted ahead of a filling station (6).

15. A method according to claim 11, wherein the locations of weighed containers (13) are logged.

16. A method according to claim 11, wherein after containers (13) to be checked have been picked up, those containers (13) that were checked before they are inserted into those locations left vacant by the former.

17. A method according to claim 11, wherein the containers (13) to be checked are filled while switching from one nest to another.

* * * * *